US005103158A

United States Patent [19]

Cho et al.

[11] Patent Number: 5,103,158

[45] Date of Patent: Apr. 7, 1992

[54] REFERENCE VOLTAGE GENERATING CIRCUIT

[75] Inventors: Shizuo Cho, Miyazaki; Tsuneo Takano; Masaru Uesugi, both of Tokyo, all of Japan

[73] Assignee: Oki Electric Industry Co., Ltd., Tokyo, Japan

[21] Appl. No.: 682,189

[22] Filed: Apr. 8, 1991

[30] Foreign Application Priority Data

Apr. 13, 1990 [JP] Japan ..... 2-98483

[51] Int. Cl.[5] ..... G05F 3/16

[52] U.S. Cl. ..... 323/314; 323/316; 307/296.8

[58] Field of Search ..... 323/313, 314, 315, 316; 307/296.1, 296.6, 296.8

[56] References Cited

U.S. PATENT DOCUMENTS

| | | | |
|---|---|---|---|
| 4,068,134 | 1/1978 | Tobey, Jr. et al. | 323/314 |
| 4,327,320 | 4/1982 | Oguey et al. | 323/313 |
| 4,346,344 | 8/1982 | Blauschild | 323/316 |
| 4,357,571 | 11/1982 | Roessler | 323/314 |
| 4,588,941 | 5/1986 | Kerth et al. | 323/314 |
| 4,868,482 | 9/1989 | O'Shaughnessy et al. | 323/313 |

OTHER PUBLICATIONS

Furuyama et al., "A New On-Chip Voltage Converter for Submicrometer High Density Dram's", IEEE Journal of Solid-State Circuits, SC-22 [3] (1987-6), pp. 437 to 441.

*Primary Examiner*—Peter S. Wong
*Attorney, Agent, or Firm*—Edward D. Manzo

[57] ABSTRACT

A reference voltage generating circuit in a CMOS semiconductor integrated circuit comprises a first reference voltage circuit for generating a first reference voltage by means of a MOS transistor having a first channel type, a second reference voltage circuit for generating a second reference voltage by means of a MOS transistor having a second channel type, and a comparator circuit for comparing the first and second reference voltages and feeding back the output corresponding to the result of the comparison, to the first reference voltage circuit to produce a third reference voltage.

24 Claims, 3 Drawing Sheets

REFERENCE VOLTAGE GENERATING CIRCUIT

FIELD OF THE INVENTION

The present invention relates to a reference voltage circuit provided in an internal voltage generating circuit in a CMOS semiconductor integrated circuit.

BACKGROUND OF THE INVENTION

A prior art in this technical field is described in IEEE Journal of Solid-State Circuits, SC-22 [3] (1987-6), page 437 to 441, "A New On-Chip Voltage Converter for Submicrometer High Density DRAM's". Its configuration will next be described with reference to the drawings.

FIG. 2 is a block diagram showing an example of configuration of internal voltage generating circuit having a conventional reference voltage generating circuit.

This internal voltage generating circuit comprises a reference voltage generating circuit 10 for producing a reference voltage Vref and an internal voltage driving circuit 20 responsive to the reference voltage Vref and supplying an internal voltage Vx to loads such as memory cell arrays.

The reference voltage generating circuit 10 is energized from a power supply voltage Vcc and is expected to produce a reference voltage Vref which is of a constant value irrespective of the fluctuations in the power supply voltage Vcc, the temperature Tj, and other environmental conditions, as well as the manufacturing variations in the parameters of the components. From the viewpoint of simplification of the fabrication process and cost reduction of the semiconductor device, it is desirable that the reference voltage generating circuit 10 be formed of MOS transistors and other MOS devices, and does not employ elements with other configurations or parameters (e.g., diodes or bipolar transistors).

The internal voltage generating circuit 20 comprises, for example, a differential amplifier operating responsive to the difference between the reference voltage Vref and the internal voltage Vx, and an output buffer responsive to the output of the differential amplifier and outputting the internal voltage Vx which is maintained constant and which can drive a large capacity, large current load.

FIG. 3 is a circuit diagram showing an example of configuration of the reference voltage generating circuit of FIG. 2. Its junction temperature-reference voltage characteristic is shown in FIG. 4.

As shown in FIG. 3, the reference voltage generating circuit 10 comprises a constant current source 11 configured for example of MOS transistors, and four serially connected N-channel MOS transistors 12*a* to 12*d* having their drain and gate commonly connected. The number of the NMOS transistors 12*a* to 12*d* can be varied to obtain the desired reference voltage Vref.

Since, in this reference voltage generating circuit, the drain and gate of each of the NMOS transistors 12*a* to 12*d* are commonly connected, all of the NMOS transistors 12*a* to 12*d* operate in the saturation region. For this reason, when a constant drain current is supplied to the NMOS transistors 12*a* to 12*d*, the variation in the drain voltage, i.e., the reference voltage Vref can be restrained over a wide range of fluctuation in the drain current because of the characteristics of MOS transistors.

The above described reference voltage generating circuit however had the following problems.

As shown in the junction temperature-reference voltage characteristics of FIG. 4, when the junction temperature of the NMOS transistors 12*a* to 12*d* increases, the reference voltage Vref output from the reference voltage generating circuit 10 decreases. When appropriate parameters are selected for the NMOS transistors 12*a* to 12*d* and the constant current source 11, the following relationship is obtained:

$$\Delta Vref/\Delta Tj = -0.0025[V/.C].$$

Assume that the reference voltage Vref exhibiting the characteristics of FIG. 4 is input to the internal voltage generating circuit 20, and the internal voltage Vx output from the internal voltage generating circuit 20 is applied to a power supply voltage terminal of a CMOS inverter in the load comprising a P-channel MOS transistor and an NMOS transistor connected in series. Since the MOS transistor drive current has a tendency to decrease with the temperature, when the junction temperature of the MOS transistor increases the voltage applied to the power supply voltage terminal of the CMOS inverter decreases, which lowers the speed of operation of the circuit in the CMOS inverter.

To prevent this, it may be contemplated to use, in place of the configuration of the reference voltage generating circuit of FIG. 3, a circuit configuration in which the reference voltage Vref is generated utilizing the forward voltage drop of a diode which is not dependent on the power supply voltage fluctuation. This however requires addition of process steps for the diodes to the fabrication of the ordinary semiconductor device fabrication process. This means the fabrication process has to be altered, the fabrication process is more complicated, and the fabrication cost is increased. This method was therefore not fully satisfactory.

SUMMARY OF THE INVENTION

The present invention aims at providing a reference voltage generating circuit which eliminates the problems of negative temperature dependency of the reference voltage and also eliminates the need for the alteration of the process fabrication for the reference voltage generating circuit in the MOS semiconductor integrated circuit.

In order to achieve the above objectives, a reference voltage generating circuit in a CMOS semiconductor integrated circuit according to the present invention comprises:

a first reference voltage circuit for generating a first reference voltage by means of a MOS transistor having a first channel type;

a second reference voltage circuit for generating a second reference voltage by means of a MOS transistor having a second channel type; and a comparator means for comparing the first and second reference voltages and feeding back the output corresponding to the result of the comparison, to said first reference voltage circuit to produce a third reference voltage.

For example, the first and second reference voltage circuits have a circuit configuration in which a constant current is supplied to a MOS transistor whose drain and gate are commonly connected; and said comparator means is configured of a differential amplifier.

According to the invention, the reference voltage generating circuit is configured as described above, the first reference voltage is generated from the first reference voltage circuit by the action of the MOS transistor (e.g., PMOS transistor) having the first channel type, and the second reference voltage is generated from the second reference voltage circuit by the action of the MOS transistor (e.g., NMOS transistor). The first and the second reference voltages are compared at the comparator means, and the output in accordance with the result of the detection is fed back to the first reference voltage generating circuit to produce the third reference voltage, which is then supplied to the load in the semiconductor integrated circuit.

By having the characteristics whereby the first and the second reference voltages are increased with the increase in the temperature, by appropriately choosing the channel length, the channel width and other characteristics of the MOS transistors in the first and the second reference voltage circuits, the delay in the circuit operation accompanying the increase in the temperature of the load circuit at the output side is compensated. The third reference voltage is determined by the MOS transistors having the first and the second channel types which are complementary to each other, the manufacturing variations in the fabrication process of the MOS transistor having the first channel type and the MOS transistor having the second channel type are compensated, and the third reference voltage which is stable against the temperature variation and process variation can be output. The above problem is thereby solved.

DETAILED DESCRIPTION OF THE PREFERRED EMBODIMENTS

Figure 1:
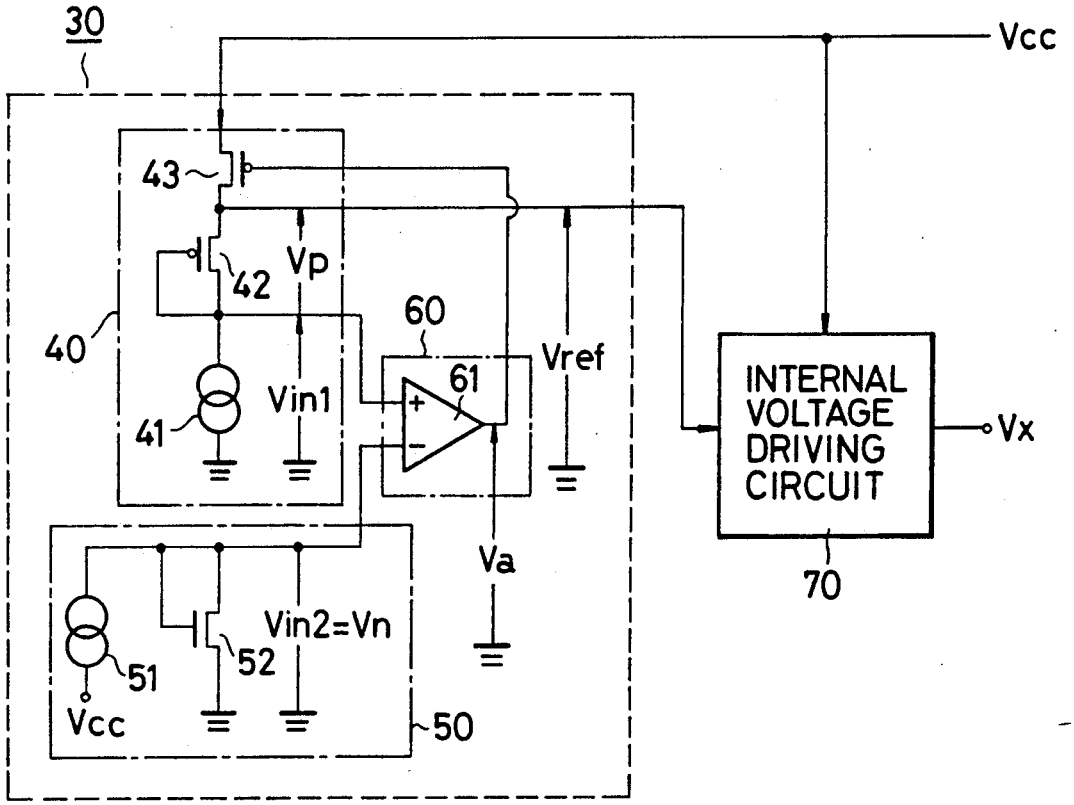
FIG. 1 is a block diagram of an internal voltage generating circuit having a reference voltage generating circuit of an embodiment of the invention.
Figure 2:
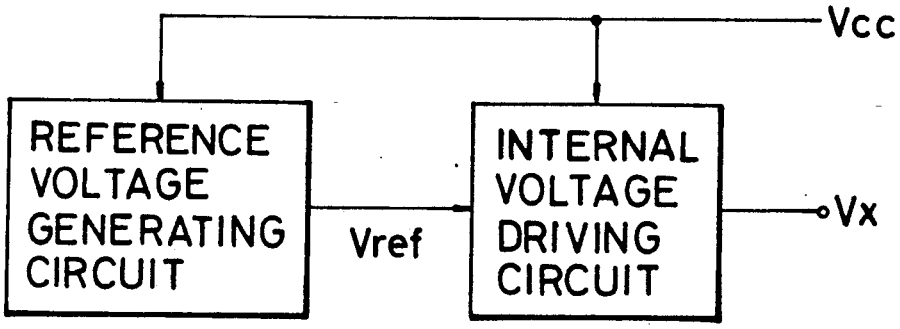
FIG 2 PRIOR ART
FIG. 2 is a block diagram of an internal voltage generating circuit having a reference voltage generating circuit in the prior art.

FIG. 1 is a block diagram showing an internal voltage generating circuit having a reference voltage generating circuit of an embodiment of the invention.

The internal voltage generating circuit is configured of CMOS semiconductor integrated circuits, and comprises a reference voltage generating circuit 30 energized from the power supply voltage Vcc to generate a reference voltage (third reference voltage) Vref, and an internal voltage driving circuit 70 which is energized by the power supply voltage Vcc and responsive to the reference voltage Vref, and supplies the internal voltage Vx to the load in the integrated circuit.

The reference voltage generating circuit 30 comprises a first reference voltage circuit 40 for outputting a reference voltage (first reference voltage) Vin1 and the reference voltage (third reference voltage) Vref for the internal voltage driving circuit 70, a second reference voltage circuit 50 for generating a reference voltage (second reference voltage) Vin2, and a comparator means 60 consisting of a differential amplifier 61 comparing the reference voltages vin1 and Vin2 and feeding back, to the first reference voltage circuit 40, a comparator output signal VA which indicates the result of the comparison.

The first reference volage circuit 40 comprises a constant current source 41 which is configured of MOS transistors etc. and which maintains a constant current through it, and PMOS transistors 42 and 43. The gate and drain of the PMOS transistor 42 are commonly connected, and the common node N1 is connected to the constant current source 41. The source of the PMOS transistor 42 is connected to the power supply voltage Vcc through the source-drain path of PMOS transistor 43. The PMOS transistor 42 generates the reference voltage Vp, and the reference voltage Vin1 is output from the common node N1.

The second reference voltage circuit 50 comprises a constant current source 51 which is configured of MOS transistors, etc. and which supplies a constant current through an NMOS transistor 52. The gate and the drain of the NMOS transistor 52 are commonly connected, and the common node N2 is connected to the constant current source 51. The source of the NMOS transistor 52 connected to the reference potential GND. The reference voltage Vin2 is output from the common node N2. The reference voltage Vin2 is equal to the reference voltage Vn generated at the NMOS transistor 52.

The differential amplifier 61 constituting the comparator means 60 has its non-inverting input terminal (+) connected to the common node N1 and its inverting input terminal (−) connected to the common node N2. The output terminal of the differential amplifier 61, producing a comparator output signal VA is connected to the gate of the PMOS transistor 43 in the first reference voltage circuit 40 for feedback. The reference voltage Vref is output from the drain of the PMOS transistor 43, and supplied to the internal voltage driving circuit 70.

The internal voltage driving circuit 70 comprises a differential amplifier operating in response to the difference between the reference voltage Vref and the voltage feed back from the internal voltage Vx, and an output buffer for outputting the internal voltage Vx which can drive a large capacity, large current load.

Figure 5:
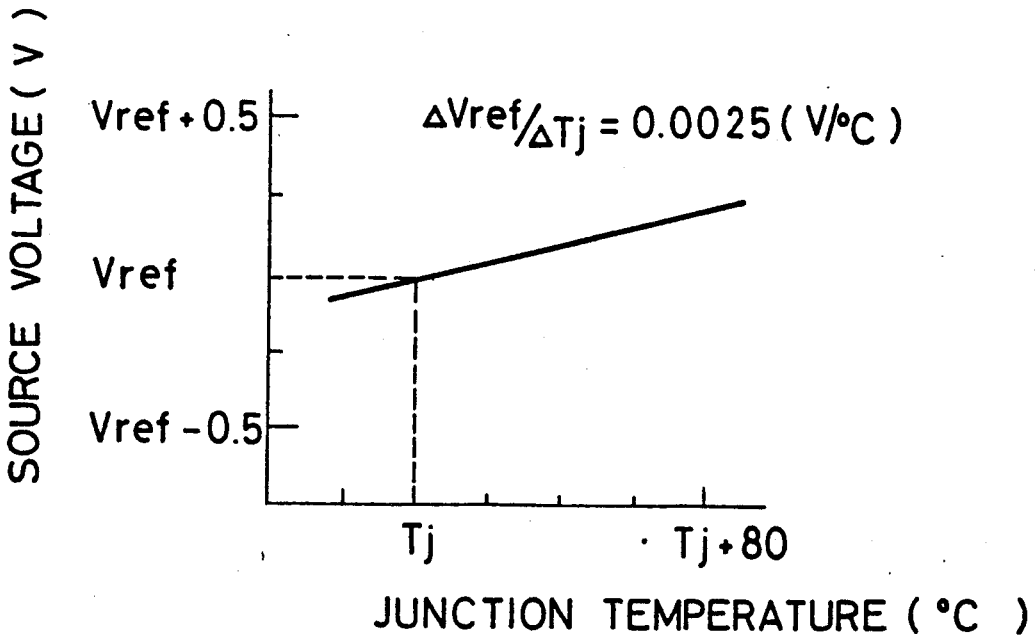
FIG. 5 is a diagram showing the junction temperature-reference voltage characteristics of the reference voltage generating circuit of FIG. 1.

FIG. 5 is a junction temperature-reference voltage characteristics diagram of the reference voltage generating circuit 30 shown in FIG. 1. The operation of the circuit of FIG. 1 will now be described with reference to FIG. 5.

In FIG. 1, when the power supply voltage Vcc is applied, since the PMOS transistor 42 and the NMOS transistor 52 have their drain and gate commonly connected, they operate in the saturation region. When the constant drain current flows through the PMOS transistor 42 by the action of the constant current source 41, the reference voltage vin1, in which variation is restrained to the minimum due to the MOS transistor characteristics over a wide range despite the width of the current variation, is output from the common node N1 of the drain of the PMOS transistor 42. The reference voltage Vin1 is applied to the non-inverting input terminal (+) of the differential amplifier 61.

When the constant current is supplied from the constant current source 51 to the drain of the NMOS transistor 52, the reference voltage Vin2, in which variation is restrained to the minimum due to the MOS transistor characteristics over a wide range despite the width of the current variation, is output from the common node N2 of the drain of the NMOS transistor 52. The reference voltage Vin2 is applied to the inverting input terminal (−) of the differential amplifier 61. The differential amplifier 61 compares the reference voltages Vin1 and Vin2, and outputs the comparator output signal VA of a High level or a Low level, to turn on or off the PMOS transistor 43. More specifically, when the output of the differential amplifier 61 is High, the PMOS transistor 43 is turned off. When the output of the differential amplifier 61 is Low, the PMOS transistor 43 is turned on. Accordingly, the stable reference voltage Vref is output from the drain of the PMOS transistor 43, and applied to the internal voltage driving circuit 70. The internal voltage driving circuit 70 is responsive to the reference voltage Vref and supplies the internal voltage Vx to power the load in the semiconductor integrated circuit.

Now let us consider the reference voltage Vn generated at the NMOS transistor 52 in FIG. 1. The temperature characteristics of the reference voltage Vn accompanying the increase in the junction temperature of the NMOS transistor 52 is either of the following two types depending on how the channel length, the channel width and other parameters are selected. That is, the NMOS transistor 52 (this also applies to a PMOS transistor) has its threshold value decreased and its mutual conductance $g_m$ decreased when the junction temperature is increased. Accordingly, the types of the temperature characteristics are as follows:

(1) The type in which Vn decreases with the junction temperature increase, because the decrease in the threshold value is greater than the decrease in $g_m$.

(2) The type in which Vn increases with the junction temperature increase, because the decrease in the threshold value is smaller than the decrease in $g_m$.

Figure 3:
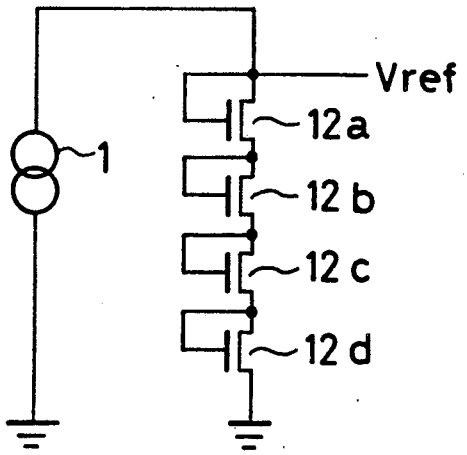
FIG 3 PRIOR ART
FIG. 3 is a circuit diagram of the reference voltage generating circuit of FIG. 2.

In the conventional system of FIG. 3, the type (1) is selected.

In the present embodiment, it is assumed that the type (2) is selected for the reference Vn, and the reference voltage Vn increases with temperature increase. Similarly, the reference voltage Vp can have either of the two types of the temperature characteristics. It is assumed that the reference voltage Vp increases, like the NMOS transistor 52.

With regard to the reference voltage generating circuit 30, the following relationship holds:

$$Vin1 = Vref - Vp$$

$$Vin2 = Vn$$

The output signal VA from the differential amplifier 61 which receives the reference voltage Vin1 and Vin2 is controlled to assume the following values:

$$VA = \text{High when } Vin1 > Vin2$$

$$VA = \text{Low when } Vin1 < Vin2$$

Since the comparator output signal VA is fed back to the gate of the PMOS transistor 43, the following relationship holds:

$$Vin1 \text{ approximately equals } Vin2$$

Accordingly, $$Vref \text{ approximately equals } Vn + Vp$$

Since $$Vn > 0, \text{ and } Vp > 0$$

when the junction temperature increases, the reference voltage is always positive.

Figure 4:
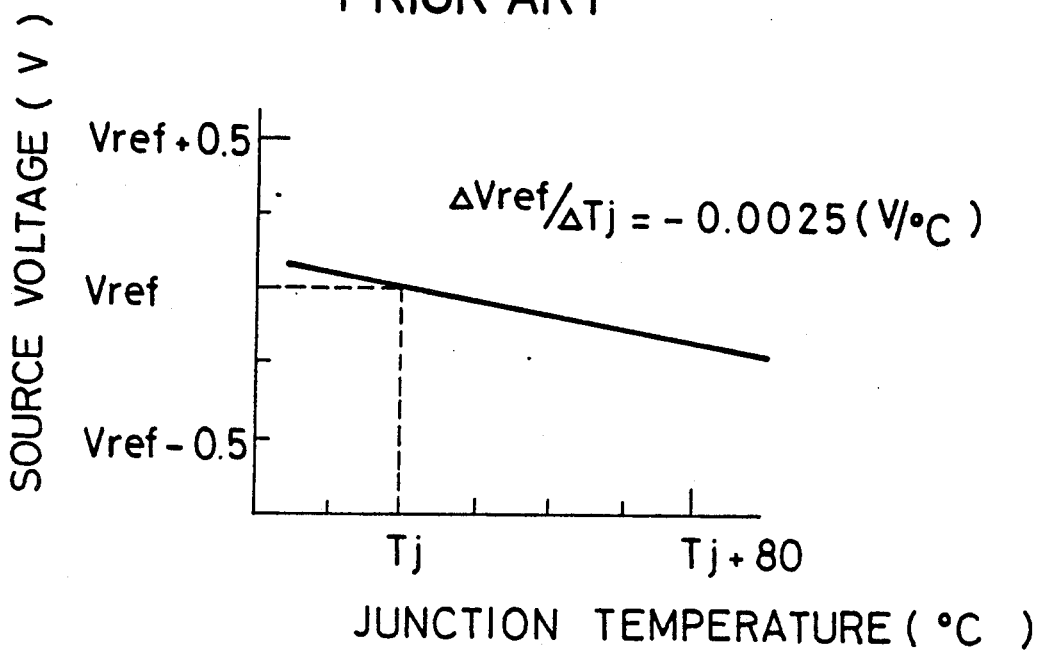
FIG 4 PRIOR ART
FIG. 4 is a diagram showing the junction temperature-reference voltage characteristics of the circuit of FIG. 3.

Moreover, the set value of the reference voltage Vref is represented by the sum (Vn+Vp) for any parameters of the PMOS transistor and NMOS transistor, so the manufacturing variations in the fabrication process of the PMOS transistor and NMOS transistor can be expressed by the reference voltage Vref. Accordingly, by appropriately selecting the parameters of the PMOS transistor and the NMOS transistor, the temperature characteristics shown in FIG. 5 is obtained by computer simulation. The temperature characteristics is of the positive gradient which is opposite to that of FIG. 4, and the reference voltage Vref increases with the junction temperature.

The advantages of the present embodiment are as follows:

(a) Since the reference voltage Vref has a positive gradient with respect to the junction temperature increase as shown in FIG. 5, delay in the circuit operation, and hence the degradation in the mutual conductance $g_m$ accompanying the temperature increase of the internal voltage generating circuit having the reference voltage generating circuit 30 are compensated.

(b) The reference voltage Vref output from the reference voltage generating circuit 30 is determined by both of the PMOS transistor 42 and the NMOS transistor 52, so manufacturing variations in their fabrication process are compensated, and a stable reference voltage Vref can be supplied to the internal voltage drive driving circuit 70.

(c) Since the temperature dependence of the reference voltage Vref is positive, and the reference voltage Vref increases with the temperature increase, a stable internal voltage Vx can be supplied to the load via the internal voltage driving circuit 70, and delay in the circuit operation of the load can be prevented. Accordingly, the reference voltage generating circuit need not be built using the forward voltage drop or the like which is not dependent on the power supply voltage fluctuation, as in the prior art, so special fabrication process (for diodes or the like) need not be added, and the reference voltage generating circuit 30 can be formed with the ordinary fabrication process of MOS semiconductor integrated circuits, and the cost of the fabrication of the circuit in the form of an integrated circuit can be lowered.

The present invention is not limited to the illustrated embodiment, but various modifications are possible. Examples of the modifications are set forth below:

(i) The PMOS transistor 42 and the NMOS transistor 52 are of a single stage configuration, but they may be of a multiple stage configuration in order to obtain the desired reference voltage Vp and Vn.

(ii) In FIG. 1, the output of the differential amplifier 61 is shown to be fed back to the gate of the PMOS transistor 43 in the reference voltage circuit 40, but another NMOS transistor may be provided in the second reference voltage circuit 50 and the output of the differential amplifier 61 may be fed back to the gate of said another NMOS transistor. Substantially identical functions and effects will still be obtained.

(iii) The comparator means 60 is shown to comprise the differential amplifier 61, but may alternatively comprise other circuits using MOS transistors and the like.

As has been described in detail, according to the invention, the first and the second reference voltages are generated from the first and the second reference voltage circuit, and are compared at the comparator means, and the output of the comparator means is fed back to the first reference voltage circuit to produce the third reference voltage. The third reference voltage is therefore determined in accordance with both of the MOS transistor having the first channel type and the MOS transistor having the second channel type. The manufacturing variations in the fabrication process of either of the transistors can be compensated, and a stable reference voltage can be output.

Moreover, by appropriately selecting the parameters of the MOS transistor having the first channel type and the MOS transistor having the second channel type, the temperature dependence of the third reference voltage can be made to be positive, so that the third voltage increases with the temperature increase, and the delay in the operation of the circuit driven by the third reference voltage can be prevented. Moreover, in comparison with the prior art in which the reference voltage generating circuit is formed using the forward voltage drop of a diode which is not dependent on the power supply voltage fluctuations, special fabrication steps for a diode or the like need not be added in the fabrication process of the semiconductor integrated circuit, so the fabrication process of the semiconductor integrated circuit can be simplified and the cost can be lowered.

What is claimed is:

1. A reference voltage generating circuit in a CMOS semiconductor integrated circuit, comprising:

a first reference voltage circuit for generating a first reference voltage by means of a MOS transistor having a first channel type;

a second reference voltage circuit for generating a second reference voltage by means of a MOS transistor having a second channel type; and a comparator means for comparing the first and second reference voltages and feeding back the output corresponding to the result of the comparison, to said first reference voltage circuit to produce a third reference voltage.

2. The circuit of claim 1, wherein each of said first and second reference voltage circuits has a circuit configuration in which a constant current is supplied to a MOS transistor whose drain and gate are commonly connected.

3. The circuit of claim 1, wherein said comparator means is configured as of a differential amplifier.

4. The circuit of claim 1, wherein said first reference voltage circuit comprises a first constant current source having one terminal connected to a node of a reference potential;

a first MOS transistor having its gate and drain commonly connected to the other terminal of said first constant current source; and a second MOS transistor having its drain connected to the source of said first MOS transistor and having its source connected to a power supply node;

the output of said comparator means being connected to the gate of said second MOS transistor; said first constant current source maintaining a constant current through it and through said first and second MOS transistors; and said first reference voltage being obtained across said first constant current source.

5. The circuit of claim 4, wherein said second reference voltage circuit comprises:

a second constant current source having one terminal connected to said power supply node; and a third MOS transistor having its drain and gate commonly connected to the other terminal of said second constant current source and having its source connected to said node of said reference potential;

said second constant current source supplying a constant current through said third MOS transistor; and said second reference voltage being obtained across said drain and said source of said third MOS transistor.

6. The circuit of claim 5, wherein said comparator means produces a High output when said first reference voltage is greater than said second reference voltage to turn off said second MOS transistor of said first reference voltage circuit; and said comparator means produces a Low output when said first reference voltage is smaller than said second reference voltage to turn on said second MOS transistor of said first reference voltage circuit.

7. The circuit of claim 1, wherein parameters of the MOS transistors are so selected that said first and said second reference voltages have a tendency to increase with temperature.

8. The circuit of claim 1, wherein said parameters include a channel length and a channel width of said MOS transistors.

9. The circuit of claim 1, wherein said first reference voltage circuit comprises a first MOS transistor having its gate and drain connected to each other; and a second MOS transistor having its drain connected to the source of said first MOS transistor and having its source connected to a power supply node;

the output of said compactor means being connected to the gate of said second MOS transistor; and said first reference voltage circuit produces said first reference voltage at the drain of said first MOS transistor.

10. The circuit of claim 9 wherein said second reference voltage circuit comprises a third MOS transistor having its drain and gate connected to each other and having its source connected to said node of said reference potential; and said second reference voltage circuit produces said second reference voltage across said drain and said source of said third MOS transistor.

11. A method of generating a reference voltage in a CMOS semiconductor integrated circuit comprising the steps of:

applying voltage to a PMOS transistor to provide a first reference voltage;

applying voltage to a NMOS transistor to provide a second reference voltage;

combining the first and second reference voltages to provide a third reference voltage to be outputted from the circuit.

12. The method of claim 11 wherein said step of applying voltage to a PMOS transistor includes coupling the PMOS transistor in circuit with a constant current source.

13. The method of claim 11 wherein said step of applying voltage to an NMOS transistor includes coupling the NMOS transistor in circuit with a constant current source.

14. The method of claim 11 wherein said step of combining includes generating a combined signal obtained from combining said first and second reference voltages and controlling the conductivity of a further transistor with said combined signal.

15. The method of claim 14 wherein said step of generating a combined signal comprises comparing said first reference voltage with said second reference voltage in a comparator circuit, an output of the comparator circuit comprising the combined signal.

16. The method of claim 14 wherein said step of controlling the conductivity comprises coupling a further transistor so that its source-drain path is in series with the source-drain path of the PMOS or NMOS transistor and applying the combined signal to a gate electrode of the further transistor.

17. A reference voltage generating circuit coupled to first and second voltage supply nodes, comprising:

a first reference voltage circuit for generating a first reference voltage at a first output node;

said first reference voltage circuit including a first MOS transistor and a second MOS transistor of a first channel type;

said first MOS transistor having gate and drain electrodes commonly connected to the first output node;

said second MOS transistor having a drain electrode connected to the source electrode of said first MOS transistor through a second output node, and having a source electrode connected to the first voltage supply node;

a second reference voltage circuit for generating a second reference voltage at a third output node;

said second reference voltage circuit including a third MOS transistor of a second channel type;

said third MOS transistor having drain and gate electrodes commonly connected to the third output node and having a source electrode connected to the second voltage supply node;

a comparator coupled to compare the first and second reference voltages and apply an output in response to the result of comparison to the gate electrode of said second MOS transistor;

whereby said first reference voltage circuit produces a third reference voltage at the second output node.

18. The circuit of claim 17 wherein said first channel type is a p type and said second channel type is an n type.

19. The circuit of claim 17 wherein said first reference voltage circuits comprises a first constant current source for supplying a constant current to said first and second MOS transistors; and said second reference voltage circuits comprises a second constant current source for supplying a constant current to said third second MOS transistor.

20. The circuit of claim 19, wherein said first constant current source has one terminal connected to said second voltage supply node;

said gate and drain electrodes of said first MOS transistor are commonly connected to the other terminal of said first constant current source; and said first reference voltage circuit produces said first reference voltage across said first constant current source.

21. The circuit of claim 20, wherein said second constant current source has one terminal connected to said first voltage supply node;

said drain and gate electrodes of said third MOS transistor are commonly connected to the other terminal of said second constant current source; and said second reference voltage circuit produces said second reference voltage across said drain and source electrodes of said third MOS transistor.

22. The circuit of claim 21, wherein said comparator produces a high output when said first reference voltage is greater than said second reference voltage to turn off said second MOS transistor; and said comparator produces a low output when said first reference voltage is smaller than said second reference voltage to turn on said second MOS transistor.

23. The circuit of claim 17, wherein parameters of the first, second and third MOS transistors are so selected that said first and said second reference voltages have a tendency to increase with the temperature.

24. The circuit of claim 17, wherein said parameters include a channel length and a channel width of said MOS transistors.

* * * * *